United States Patent [19]

Manger et al.

[11] 4,112,890

[45] Sep. 12, 1978

[54] CONTROLLED IGNITION SYSTEM FOR AN INTERNAL COMBUSTION ENGINE TO PROVIDE, SELECTIVELY, ONE OR MORE IGNITION PULSES FOR ANY IGNITION EVENT

[75] Inventors: Hansjörg Manger, Schwieberdingen; Gerhard Söhner, Remshalden; Gerd Hohne, Ludwigsburg, all of Fed. Rep. of Germany

[73] Assignee: Robert Bosch GmbH, Stuttgart, Fed. Rep. of Germany

[21] Appl. No.: 776,740

[22] Filed: Mar. 11, 1977

[30] Foreign Application Priority Data

Apr. 15, 1976 [DE] Fed. Rep. of Germany ..... 2616693

[51] Int. Cl.[2] ..... F02P 5/04

[52] U.S. Cl. ..... 123/117 R; 123/148 E

[58] Field of Search ..... 123/148 E, 117 R, 149 C, 123/119 A

[56] References Cited

U.S. PATENT DOCUMENTS

| | | | |
|---|---|---|---|
| 3,853,103 | 12/1974 | Wahl et al. | 123/117 R |
| 3,881,458 | 5/1975 | Roozenbook et al. | 123/148 E |
| 3,923,021 | 12/1975 | Stark | 123/117 R |
| 3,923,022 | 12/1975 | Scholl | 123/148 E |

*Primary Examiner*—Charles J. Myhre
*Assistant Examiner*—Raymond A. Nelli
*Attorney, Agent, or Firm*—Flynn & Frishauf

[57] ABSTRACT

To provide a first accurately timed ignition impulse for any one ignition event, and then, selectively, one or more ignition pulses, in accordance with sensed or existing operating parameters of the engine, a first ignition pulse is generated, accurately, in accordance with timing as determined by an ignition timing stage; a frequency generator is selectively enabled upon the presence or absence of operating parameters at certain values to provide sequential ignition pulses after the first, accurately timed ignition pulse has been provided.

17 Claims, 4 Drawing Figures

CONTROLLED IGNITION SYSTEM FOR AN INTERNAL COMBUSTION ENGINE TO PROVIDE, SELECTIVELY, ONE OR MORE IGNITION PULSES FOR ANY IGNITION EVENT

Cross reference to related applications and patent:
U.S. Ser. No. 776,739, filed Mar. 11, 1977 Rabus et al;
U.S. Ser. No. 776,735, filed Mar. 11, 1977, Grather et al;
U.S. Ser. No. 776,738, filed Mar. 11, 1977, Rabus et al;
U.S. Pat. No. 3,881,458;
all assigned to the assignee of the present application.

The present invention relates to an ignition system for internal combustion engines, and more particularly to an ignition system for an automotive-type internal combustion engine in which operating and environmental parameters of the condition of the engine, and its operation, can be considered.

BACKGROUND AND PRIOR ART

In ignition systems of the type to which the present invention relates, an ignition coil has a controlled switch connected in the primary circuit thereof, the secondary being connected to one or more spark plugs, preferably through a distributor. An ignition control element, for example an inductive transducer, controls the operation of the controlled switch to pass current therethrough and charge the ignition coil. The controlled switch is closed at a predetermined instant of time, causing rapid rise of current through the ignition coil which will terminate in a saturation current if the switch remains closed for a long enough period of time. Upon opening of the switch, the secondary voltage provides a pronounced voltage kick which has a high enough voltage to cause breakdown of the spark gap of the spark plug if the ignition system is connected to an internal combustion engine, for example of the automotive type. The transducer provides an ignition signal at a predetermined time with respect to an operating state of the internal combustion (IC) engine, for example with respect to the upper dead center (UDC) position of a piston thereof. Suitable ignition timing circuits or other arrangements can be used to shift the ignition signal to provide for advance or retard of the spark with respect to the UDC position of the piston in accordance with various operating or environmental parameters of the internal combustion engine. The ignition timing signal not only controls closing of the switch but primarily controls opening thereof at a predetermined timing instant. A dwell angle control arrangement is provided to close the switch at a proper time so that sufficient current can flow through the coil to store magnetic energy therein, so that the coil will be essentially in saturation and provide, at the proper ignition instant, the full magnetic energy to the spark gap, typically a spark plug. Dwell angle control systems have been previously described, see, for example, the cross-referenced U.S. Pat. No. 3,881,458 (to which German Disclosure Document DT-OS 2,244,781 corresponds). Such ignition systems have a disadvantage, however, in that it is possible that the spark may be too weak or too short, resulting in insufficient or incomplete combustion of the fuel-air mixture in the IC engine. In the limiting case, a misfire may occur, resulting in no combustion of the mixture at that time at all.

It has been proposed to ensure ignition of the fuel-air mixture in the respective cylinder by providing a spark train, that is, a plurality of firings for each ignition event, occurring rapidly, one after the other. Sequential ignition pulses are generated by enabling a frequency generating to provide a pulse train to a control switch connected to the spark plug, at any ignition event, or with respect to any ignition instant, so that the coil will then provide a pulse train to the spark plug. This system has a disadvantage in that the frequency generator will provide control for the coil of the spark plug only after the ignition instant. Thus, the switch must first close to store magnetic energy in the ignition coil so that, upon subsequent opening, a spark impulse is delivered therefrom to the spark plug. The first firing or arc-over of the spark plug thus occurs at a period of time which is delayed with respect to the actually desired ignition instant.

THE INVENTION

It is an object to provide an ignition system which provides a spark train or a pulse train to cause a plurality of firings for any ignition event and which further is so arranged that the first firing or arc-over at a spark plug occurs exactly at a predetermined ignition instant. Additionally, the system should be capable of selectively providing either one, or more spark pulses to the spark plug, as determined by operating conditions or parameters of operation of the engine.

Briefly, the ignition pulse control stage is connected to, and controls operation of a switch which commands current flow through the ignition coil at a predetermined time after the occurrence of a preceding ignition event, and in advance of the next subsequent ignition event, to ensure that the coil will reach saturation; the ignition pulse control stage additionally control opening of the switch as determined by the timing of the first, or the only ignition pulse for the next subsequent ignition event, with respect to the UDC position of the respective piston. Frequency generator means are also provided to generate a plurality of ignition pulses, and likewise connected to the ignition coil interrupter switch, to control repetitive opening and closing thereof after the first closing and opening, or change of state of the switch as commanded directly by the ignition pulse control stage. The frequency generator operates at a rate which is rapid with respect to the recurrence rate of ignition events; the frequency generator is selectively connected to the interrupter switch in dependence on the presence or magnitude of operating conditions or parameters rendering desirable the use of multiple ignition sparks in the form of trains of spark plug firings.

The frequency generator, preferably, is enabled only when at least one of the various operating parameters undesirably affecting ignition is present. Such typical operating parameters are battery voltage level, temperature, whether the engine is under starting condition, vacuum in the induction pipe of the engine, whether the engine is then accelerating, its speed, incompleteness of combustion, and the like.

The system ensures reliable and uniform ignition since, first, a spark is generated at the proper ignition instant and, then, a plurality of spark trains may follow, if needed. To protect the spark plug, however, and other circuit elements of the ignition systems, a spark train may not be needed and can thus be disconnected unless the operating conditions of the system indicate that it would be desirable to provide such a spark train.

DRAWINGS

Illustrating an example:

Figure 1:
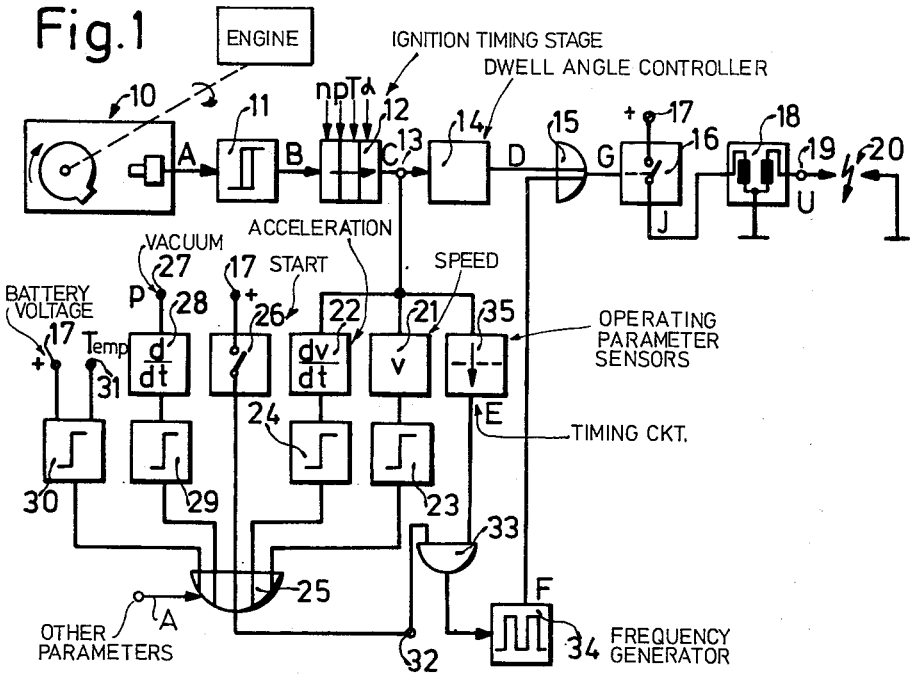
FIG. 1 shows, in schematic block diagram form, an embodiment of the invention in an ignition system using a frequency generator.

The crankshaft of an internal combustion engine E (FIG. 1) is coupled to a transducer 10 which provides pulsed output signals occurring at a predetermined time or position of a piston in the cylinder, with respect to the upper dead center (UDC) position of the piston, for example. The output from transducer 10 is applied through a wave-shaping circuit 11, preferably a Schmitt trigger. Transducer 10 is preferably an inductive transducer, but may have other forms, for example a breaker contact, a Hall generator, an optocoupler, or the like. The output of the wave-shaping stage 11 is connected through an ignition timing stage 12 to its output terminal 13 which, in turn, is connected to a dwell angle controller 14. The ignition timing stage 12 shifts the ignition signal derived from wave-shaping stage 11 in dependence on motor parameters to provide for proper ignition under the then existing operating conditions. Typical motor parameters are engine speed ($n$), induction pipe pressure or, rather, vacuum ($p$), temperature (T) and deflection angle ($\alpha$) of the throttle; other parameters may also be introduced. Such ignition timing stages are well known and need not be described in detail. The dwell angle controller 14 is also known and described, for example, in the cross-referenced U.S. Pat. No. 3,881,458. The output of the dwell angle controller 14 is connected through an OR-gate 15 with the control input of an electrical interrupter switch 16. Switch 16 preferably is a controlled semiconductor, typically a transistor. It is connected with one terminal of its main current carrying path to a positive supply terminal 17, for example the battery of a vehicle in which the IC engine E is included. The other terminal of switch 16 is connected to the primary of an ignition coil 18, the secondary of which is connected through its output terminal 19 with a spark gap 20, for example a spark plug. The second terminal of the coil 18 as well as of the spark plug is connected to ground or chassis. The spark gap, for use with an internal combustion engine, is usually a spark plug and, for multi-cylinder engines, a distributor is interposed between the output terminal 19 and the various spark plugs of the engine.

In accordance with the present invention, various operating parameters can be used to control opening and closing of the switch 16, selectively; to this end, terminal 13 is connected to a group of control circuits which, selectively, enable a frequency generator 34. Terminal 13, the output of the ignition timing stage 12, is connected to a circuit which includes, in parallel, a speed measuring stage 21, an acceleration measuring stage 22, and a timing circuit 35. The outputs of the acceleration stage 22 and of the speed stage 21 are connected to threshold circuits 24, 23, respectively, the outputs of which are connected to inputs of an OR-gate 25. Speed sensors are well known in the automotive electronics field; acceleration sensors are also known, and are used, for example, in combination with wheel brake anti-block systems. Essentially, an acceleration sensor is a speed sensing circuit with a differentiating stage connected to its output.

A terminal of a starting switch 26, which is further connected to the positive terminal 17 forming the power supply, is also connected to a further input of the OR-gate 25. OR-gate 25 can have other operating parameters for example in the form of threshold signals applied thereto. Terminal 27 is connected to a pressure switch — not shown — and located in the induction pipe of the IC engine E to measure the vacuum in the induction pipe thereof, that is, the pressure $p$. The terminal 28 is connected to a differentiating stage 28, the output of which is connected to a threshold circuit 29 which, in turn, is connected to the OR-gate 25. Change in pressure of the induction pipe of the IC engine E results in a differentiated output signal from differentiating stage 28. If the change in pressure exceeds the threshold limit of switch 29, threshold stage 29 will change and provide an output signal to OR-gate 25.

A threshold stage 30 is connected to OR-gate 25, the input of which is connected to terminal 17 to form a sensing input for battery voltage; another input of threshold switch 30 is connected to a temperature sensor, preferably in temperature sensing relationship with the IC engine E. A signal is derived from threshold switch 30 when either the temperature T or the battery voltage drops below a predetermined value.

The output of the OR-gate 25 is connected to a terminal 32 which forms one input of an AND-gate 33. AND-gate 33 has its output connected to frequency generator 34. Frequency generator 34 provides square wave pulses if its input is enabled by the AND-gate 33. The second input to AND-gate 33 is derived from timing circuit 35, connected to the terminal 13. Timing circuit 35, preferably, is a monostable circuit. The output from frequency generator 34 is connected to the second input of OR-gate 15.

Figure 2:
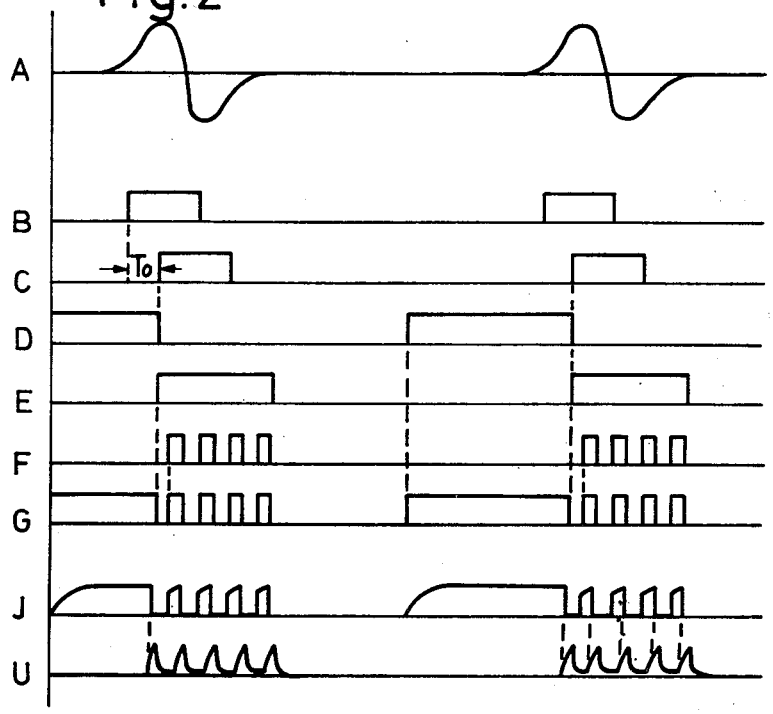
FIG. 2 shows, in sequential graphs, the signals arising in the ignition system.

Operation, with reference to FIG. 2: The signal of graph A from transducer 10 is converted into square wave signals B in the wave-shaping stage 11. The graph letter indications are also shown in FIG. 1 to illustrate where the respective signals arise. The ignition timing stage 12 shifts the signal B by a time $To$, in accordance with the ignition timing — engine operating characteristics in view of the input parameters to the timing stage 12. The output signal C will appear at terminal 13. The dwell angle controller 14 so changes the signal C that the start of a C signal, which is simultaneously the ignition instant, corresponds to the end of a preceding signal in the dwell angle controller. Thus, the output signal D terminates at the beginning of the ignition impulse, as timed by the ignition timing stage 12. The beginning of the signal D supplied by the dwell angle controller 14 is determined by the preceding C signal in such a manner that the length of the signal, or the duration of the signal D, is sufficient to provide enough primary current to the ignition coil 18 to bring coil 18 into saturation.

The rising flank of the signal of graph C also controls starting of the timing interval of timing circuit 35. The output signal of timing circuit 35 is shown on graph E of FIG. 2. If terminal 32 has a signal applied thereto — as will be explained below — frequency generator 34 is enabled during the time of the timing circuit 35 to provide the pulse sequence of the graph F. OR-gate 15 passes the signal of graph D as well as the signal of graph F, so that the interrupter switch 16 is sequentially opened and closed by the composite signals as seen in graph G. The longer signal G, which is also part of the signal D, first closes switch 16, permitting the current I through coil 18 to rise and certainly reach saturation. At the end of signal D, that is, at the ignition instant, switch 16 will open generating an ignition pulse U across spark plug 19. The subsequent signal of the signal train F causes closing of the switch 16, permitting the current through the coil to rise. This current is shown in graph J. Upon termination of the signal of graph F, interrupter switch 16 causing a new ignition pulse, and hence arc-over of the spark plug 20. This pulse occurs at the same ignition event, that is, in a multi-cylinder engine will be at the same spark plug as that of the first pulse caused by the termination of the signal D. Subsequent signals of the pulse train F, and part of the signal G passed by OR-gate 15, again cause closing of the switch, rise of current through coil 19 and, upon subsequent opening, a renewed spark pulse across the spark plug. This cycle will repeat in dependence on the number of signals from frequency generator F. If the signals of generator F are very close together, as illustrated in the diagram, it may occur that the magnetic energy in coil 18 is not completely transformed into electrical energy at each ignition spark. Upon the next subsequent closing of switch 16, current through the coil thus will not rise from a zero value but rather will start at an increased value. Time to saturation of the coil will decrease. As a consequence, the frequency of the pulses of the pulse rain causing repetitive sparking can be selected to be high, and substantially higher than the repetition recurrence of the signals B or C, and hence of the signals D.

The frequency generator 34 is controlled to operate, or not, depending on the signals at AND-gate 33. This signal is controlled not only by the timing circuit 35, which determines the length of the signals during which the frequency generator 34 will be effective, but also by the presence of a signal at terminal 32. Terminal 32, therefore, determines whether a single spark is to be generated, derived from termination of the signal D, or whether multiple signals should be provided resulting in a spark train. If, in any event, a spark train should occur, the AND-gate 33 can be omitted and the output of timing circuit 35 can be directly connected to the input of the frequency generator 34. The elements 21, 22, 26, 28, 30, and associated threshold circuits then can be omitted. In accordance with a feature of the invention, however, a train of ignition pulses, and hence a train of sparks, is provided only if certain operating conditions pertain: Terminals 17 and 31, having representative values of vehicle battery voltage and engine temperature applied thereto, have signals thereat indicative of a certain low temperature, or supply voltage below a minimum value; terminal 27, having the vacuum applied thereto, through the differentiator provides a signal that the induction pipe vacuum had a predetermined rate of change with respect to time; starting switch 26 is operated; or speed, or acceleration were above certain limiting upper, or lower values.

All the threshold stages 23, 24, 29, 30 may have an upper and a lower threshold value, so that trains of spark pulses for spark trains are provided within certain operating ranges of the respective parameter, for example below a certain limiting value and above a certain limiting value, indicating, in either case, extremes of operating conditions.

If it is not desired to control operation of the frequency generator with any one of the parameters indicated in FIG. 1, then the respective element and the associated threshold switch, if used, can be omitted. Other parameters may also be introduced, and such additional operating-dependent parameters are schematically indicated by arrow A, to introduce further inputs, directly or through a threshold stage, to provide an output at terminal 32 and hence enable the AND-gate 33. One such parameter may, for example, be sensed composition of exhaust gases.

Figure 3:
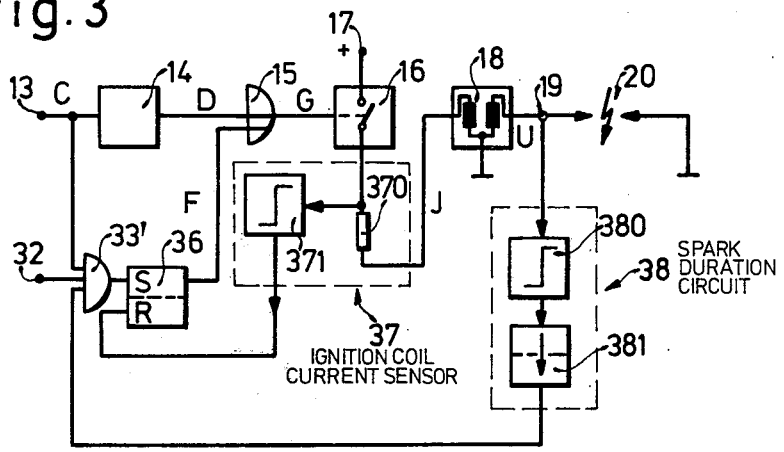
FIG. 3 is a fragmentary diagram of the ignition system illustrating in detail a circuit arrangement to generate a spark pulse train.

Embodiment of FIG. 3: Only those elements which differ from the ones previously described will be explained in detail; similar reference numerals to those of FIG. 1 have been used.

Terminal 13 is directly connected to the input of AND-gate 33', which has three inputs. AND-gate 33' has its output connected to the SET input S of a flip-flop (FF) 36. The output of FF 36 is connected to the second input of the OR-gate 15. An ignition current sensor 37 is connected serially with the primary of the ignition coil 18, as shown between the interrupter switch 16 and the ignition coil 18. Ignition coil current sensor 37 provides an output voltage representative of the current I through the primary of the ignition coil 18. In its simplest form, it is a resistor 370 connected to apply a voltage representative of current flow through the resistor 370 to an input of a threshold stage 371. The output of the threshold stage 371 is connected to the RESET input R of FF 36. Terminal 19, the output of the secondary of coil 18, is connected to a spark duration sensor 38. The output of the spark duration sensor 38 is connected to a further input of the AND-gate 33. The spark duration sensor 38, in its simplest form, is a threshold stage 380 which provides a signal when an ignition signal commences and is connected to a subsequent timing circuit 381 which can be so set that a predetermined time duration for the spark train can be set therein.

Operation of circuit of FIG. 3: The first closing-opening cycle of switch 16 occurs, as described in connection with FIG. 1, under control of the signal of graph D. Upon termination of the D signal, voltage will rise at terminal 19. The voltage rise is sensed by the spark duration circuit 38 and threshold circuit 380 will respond, causing the timing circuit 381 to start and provide a timing signal. At the end of the timing interval, as set by the timing circuit 381, AND-gate 33 is enabled, thus placing the FF 36 into the SET mode, since a C signal is simultaneously present. Terminal 32, if provided, must also have a signal appear thereat. The signal from terminal 32 can be provided, as described in connection with FIG. 1. The SET state of the FF 36 results in renewed closing of switch 16. Current I begins to rise and when it reaches a predetermined threshold, as determined by the stage 371, FF 36 is reset over the R input. Switch 16 thus is opened, and ignition voltage U again begins to rise. This cycle will repeat until the C signal terminates, that is, provided a signal is applied at terminal 32 (if provided). The duration of the spark train of the system of the embodiment of FIG. 3 is thus not fixed with a respect to a predetermined time — the unstable time of timing circuit 35 in FIG. 1 — but rather is governed by the duration of the output signal from the transducer, as wave shaped and transformed into the signal of graph C (FIG. 2). The duration of the signal C depends on the width of the signal A. The amplitude of this signal changes with speed, but its width is essentially constant and corresponds to a predetermined angle of rotation of the shaft of the transducer 10, and hence of the crankshaft of the engine E. Other transducers can be used which provide a signal different from one which is constant with respect to a certain angular displacement of the crankshaft of the engine. Such different transducers would, for example, be sensors to sense when the output voltage goes through null or zero, rate-of-change circuits which sense peaks and change of slope of the signal from the sensors, or slope detectors. Such circuits may use, for example, differentiating stages.

The duration of the extended spark train can also be controlled by a signal which has a predetermined set time period, for example by a timing circuit similar to timing circuit 35 which would then be included in the circuit resetting the FF 36. Similarly, a spark duration circuit like circuit 38 and an ignition coil current sensing circuit like circuit 37 may be used in connection with the system of FIG. 1.

Figure 4:
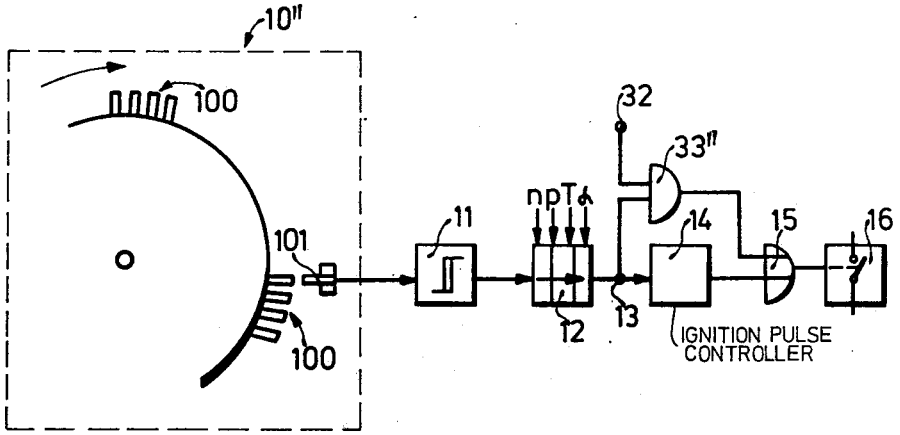
FIG. 4 is another embodiment, and using a specially designed pulse transducer to generate a plurality of spark signals and controlling operation of the system.

Embodiment of FIG. 4: The transducer 10'' has a plurality of markers for each ignition event, associated with any one cylinder or piston of the engine, rather than a single marker as illustrated in FIG. 1. Usually, the markers on the transducer are offset by a crankshaft angle which depends on the number of cylinders; for a four-cylinder engine, these markers are offset with respect to each other by 90°. The transducer 10'' (FIG. 4) has a plurality of closely adjacent markers 100; FIG. 4 illustrates four such markers 100, for example corresponding to four projections, or other magnetic discontinuities at the circumference of a rotating disk which may be part of, or coupled to the flywheel of the engine. The fixed portion of the transducer, forming a coil pick-up and schematically shown at 101, then will have four rapidly sequentially occurring pulses at its output. Four pulses similar to the signals A of FIG. 2 will therefore be provided. The stages 11 and 12 thus will provide, in each instant, four D and C signals, each one offset with respect to the signal B by the time $T_o$. The first C signal at terminal 13 controls the dwell angle controller 14, as explained in connection with FIG. 1. The output thereof will be the D signal. The output of the dwell angle control stage 14 is connected over the OR-gate 15 with the control input of the interrupter switch 16, as in FIG. 1. Terminal 13, additionally, is connected over an AND-gate 33'' with the second input of the OR-gate 15. The second input of the AND-gate 33'', as above described, is connected to terminal 32 (if provided). If no signal is applied at terminal 32, the output signal D of the dwell angle controller will provide a single spark, as described. If, however, terminal 32 is enabled, AND-gate 33 will pass sequential signals and thus the multiple C signals will be transferred from terminal 13 through the OR-gate 15. The end of the signal D, therefore, will have four signals following the D signal, resulting, overall, in five spark pulses, and five rapidly sequentially following sparks for any ignition event. The first spark, as above described, will occur upon the termination of the D signal, resulting from current flow due to the last preceding spark.

The duration of the spark train is determined by the number and the circumferential placement of the markers 100.

Collision between the control of the terminal end or trailing flank of the signal D and the start of the first C signal can be improved by connecting a time delay circuit between the terminal 13 and the connecting line from terminal 13 to the input of the AND-gate 33''. Such a delay circuit prevents coincident timing of the trailing flank or end of the signal D with the start of the first C signal. Other possibilities are open to prevent such interference, and various solutions suggest themselves, such as a coincidence circuit which, if coincidence is detected, delays transfer of one signal from input to output — in this case the signal through AND-gate 33''. Terminal 32 is controlled as described in connection with FIG. 1.

Various changes and modifications may be made and features described in connection with any one of the embodiments may be used with any of the others, within the scope of the inventive concept.

In the embodiment of FIG. 4, the pulses C (FIG. 2) will be much shorter than those shown in connection with the embodiments of FIGS. 1 and 3. Yet, because of the short-circuiting of element 14 if gate 33'' is enabled, the circuit 14 will respond but once. Commencement of current flow through the ignition pulse controller 14, as determined by the beginning of the D pulse can be controlled, inherently, from the next preceding pulse emitted by the ignition pulse controller 14 itself, that is, regardless of whether ignition pulse controller 14 had only one pulse applied, as in the embodiments of FIGS. 1 and 3, or sequential pulses were short-circuited therearound by the closed gate 33'' after the first pulse had been passed by controller 14.

We claim:

1. Ignition system to provide, selectively, one ignition impulse, or a series of ignition pulses to a spark gap (20) in which the one, or the first one of said pulses occurs at a predetermined time after occurrence of a cyclically recurring event, particularly to provide said pulses to the spark plug of an internal combustion engine (E) with respect to a predetermined angular position of the crankshaft of the engine and having an ignition coil (18), and a spark gap (20) connected to the secondary of the ignition coil;

means (10, 11, 12; 10'') determining the timing of the event;

and a controlled switch (16) in series with a source of current (17) and the primary of the ignition coil (18) to periodically supply current to the coil and generate said ignition pulse by transformer action, and comprising an ignition pulse control stage (14) connected to and controlling operation of the controlled switch (16) to command closing of the switch at a predetermined time after occurrence of the preceding event, and in advance of the next subsequent event, and to command generation of said one, or first one of said ignition pulses as determined by the timing of the next subsequent event;

and means (34; 100, 101) generating a plurality of ignition pulses connected to said controlled switch (16) and controlling said switch to repetitive operation and cause, after occurrence of said event and at a rate which is rapid with respect to the recurrence rate of said events, to provide a pulse train for generation of a train of sparks at said spark gap, the timing of the first one of said ignition pulses being determined by said ignition pulse control stage;

and means (32; 33, 33', 33'') selectively controlling application of the plurality of ignition pulses, in excess of said first pulse to said spark gap (20).

2. System according to claim 1, wherein (FIG. 1) the pulse generation means (34) has an output connected to the input of said controlled switch (16).

3. System according to claim 1, wherein (FIG. 3) the pulse generation means comprises a controlled switching circuit (36) having two inputs (R, S) controlling the switching state of said controlled switching circuit;

a current sensing circuit (37) connected to the primary of the ignition coil (18) and sensing the intensity of current flow therethrough, and a spark duration circuit (38) sensing occurrence of a spark and connected to the secondary of the coil (18);

the voltage sensing circuit and the spark duration circuit being, respectively, connected to the control inputs of the controlled switching circuit (36), the output of the controlled switching circuit being connected to and controlling operation of said controlled switch (16) to cause said controlled switch to open, and close, in dependence on occurrence of the first one of said ignition signals and, subsequently, when the current through the ignition coil reaches a predetermined value.

4. System according to claim 1, further comprising a timing circuit (35) controlling the means (34, 36) generating the plurality of ignition pulses, the timing circuit determining the time duration during which the plurality of ignition pulses are provided;

and wherein the first one of said pulses is connected to said timing circuit to start the timing interval thereof.

5. System according to claim 1, wherein the means determining the timing of the event comprises an ignition signal marking transducer (10) coupled to the internal combustion engine and providing an output signal at a predetermined angular position of a piston within the engine, the angular position of the piston upon generation of the signal determining the operating time duration of the means (34, 36) generating the plurality of ignition pulses.

6. System according to claim 1, wherein (FIG. 4) the means generating the plurality of ignition pulses comprises a pulse transducer (10″) having a plurality of closely spaced ignition pulse markers (100), coupled to the crankshaft of the engine (E) and providing a plurality of ignition pulse signals;

said ignition pulse signals being connected to the ignition pulse control stage (14);

and means (33″) bypassing the ignition pulse control stage and applying said plurality of pulses directly to the control input of the controlled switch (16).

7. System according to claim 1, for combination with the internal combustion engine comprising circuit means (25; 33) having a control input;

means (21, 22, 26, 27, 31, 17) providing sensed output signals corresponding to a parameter of operation, or operating condition of the internal combustion engine;

presence of at least one of said parameter signals at the ignition instant of any one ignition event controlling said circuit means to, in turn, control said means to generate a plurality of ignition pulses to provide said plurality of ignition pulses to the controlled switch (16).

8. System according to claim 7, wherein (FIG. 4) the means generating the plurality of ignition pulses comprises a pulse transducer (10″) having a plurality of closely spaced ignition pulse markers (100), coupled to the crankshaft of the engine (E) and providing a plurality of ignition pulse signals;

said ignition pulse signals being connected to the ignition pulse control stage (14);

means (33″) bypassing the ignition pulse control stage and applying said plurality of pulses directly to the control input of the controlled switch (16);

and wherein the output of said circuit means (32) is connected to said bypass means (33) to enable bypassing the plurality of signals from the transducer (10″) past the ignition pulse control stage directly to said controlled switch (16).

9. System according to claim 7, wherein the means determining the timing of the event comprises an ignition signal marking transducer (10) coupled to the internal combustion engine and providing an output signal at a predetermined angular position of a piston within the engine, the angular position of the piston upon generation of the signal determining the operating time duration of the means (34, 36) generating the plurality of ignition pulses;

and wherein the output of said circuit means (32, 33) is connected to control said means (34) generating the plurality of ignition pulses to provide pulses from said pulse generating means only if at least one of said parameters provides a corresponding signal to said circuit means (25, 33).

10. System according to claim 7, further comprising a timing circuit (35) controlling the means (34, 36) generating the plurality of ignition pulses, the timing circuit determining the time duration during which the plurality of ignition pulses are provided;

wherein the first one of said pulses is connected to said timing circuit to start the timing interval thereof;

and wherein the output of said circuit means (32, 33) is connected to control said means (34) generating the plurality of ignition pulses to provide pulses from said pulse generating means only if at least one of said parameters provides a corresponding signal to said circuit means (25, 33).

11. System according to claim 7, wherein one of the control inputs comprises the starting switch (26) of the starter motor for the engine (E).

12. System according to claim 7, wherein at least one of said control inputs includes a threshold stage (23, 24, 29, 30), a sensor, sensing a respective parameter being connected to sense said parameter and having its output applied to said threshold stage, the threshold stage providing, or not providing an output to the control input of the circuit means in dependence on the respective value of the sensed parameter.

13. System according to claim 7, wherein the sensed parameter comprises engine speed, and the system includes an engine speed sensor.

14. System according to claim 7, wherein the sensed parameter comprises engine acceleration and the system includes an engine speed sensor and a differentiator.

15. System according to claim 7, wherein the sensed parameter comprises engine induction pipe pressure change and the system includes a pressure sensor and a differentiator.

16. System according to claim 7, wherein the sensed parameter comprises engine temperature and the sensor comprises a temperature sensor.

17. System according to claim 7, wherein a battery is provided to furnish a source of electrical energy to the system;

and wherein the sensed parameter comprises battery voltage, and the system includes a connection from said battery to said control input and responsive to voltage level of the battery.

* * * * *